US005534477A

United States Patent [19]

Nakamura et al.

[11] Patent Number: 5,534,477

[45] Date of Patent: Jul. 9, 1996

[54] IMAGE RECEIVING SHEET FOR THERMAL TRANSFER PRINTING

[75] Inventors: Yoshinori Nakamura; Huy Sam, both of Miyagi; Yukio Kusaka, Tochigi; Shigeo Hayasi; Toshikazu Nagura, both of Kanagawa, all of Japan

[73] Assignees: Sony Corporation; New Ojl Paper Co., Ltd., both of Tokyo, Japan

[21] Appl. No.: 345,713

[22] Filed: Nov. 22, 1994

[30] Foreign Application Priority Data

Nov. 24, 1993 [JP] Japan ..... 5-319044

[51] Int. Cl.[6] ..... B41M 5/035; B41M 5/38

[52] U.S. Cl. ..... 503/227; 428/195; 428/318.4; 428/319.3; 428/319.7; 428/319.9; 428/423.1; 428/447; 428/480; 428/532; 428/913; 428/914

[58] Field of Search ..... 8/471; 428/195, 428/318.4, 319.3, 319.7, 319.9, 913, 914, 423.1, 447, 480, 532; 503/227

[56] References Cited

FOREIGN PATENT DOCUMENTS 06-72054 3/1994 Japan ..... 503/227

*Primary Examiner*—B. Hamilton Hess
*Attorney, Agent, or Firm*—Hill Steadman & Simpson

[57] ABSTRACT

An image receiving sheet for thermal transfer printing according to the present invention comprises a dye receiving layer, a foam film, an adhesive layer, a release layer, a support layer and a lubricant layer which are successively laminated. The image receiving sheet for thermal transfer printing has a seal portion consisting of the dye receiving layer, the foam film and the adhesion layer, also having a support portion consisting of the release layer, the support layer and the lubricant layer. The image receiving sheet for thermal transfer printing according to the present invention is formed such that:

(1) smoothness of the dye receiving layer is equal to or larger than 2000 seconds;

(2) the foam film contains a white inorganic pigment of 5 to 30 weight % and a micro void formed by mixing resins that are not compatible with each other, having a cushion ratio of 5 to 30% and a density of 0.7 to 1.1 g/cm$^3$ measured in accordance with a measuring method of JIS L1015;

(3) each of the seal portion and the support has more than one antistatic layer; and (4) the stiffness of the whole image receiving sheet for the thermal transfer printing ranges from 400 to 1000 standard Gurley unit when it is measured in accordance with a measuring method of TAPPI (Technical Association of the Pulp and Paper Industry) T 543pm84.

5 Claims, 3 Drawing Sheets

FIG. 2

| | stiffness ρ by Gurley | dye receiving layer | foam film kind (thickness μm) | support layer kind (thickness μm) |
|---|---|---|---|---|
| inventive example 1 | 600 | coating material (1) | a (50) | f (100) |
| inventive example 2 | 1000 | coating material (1) | a (50) | g (100) |
| inventive example 3 | 400 | coating material (1) | a (50) | h (130) |
| inventive example 4 | 600 | coating material (1) | a (50) | i (140) |
| inventive example 5 | 600 | coating material (2) | b (50) | g (100) |
| inventive example 6 | 600 | coating material (3) | b (50) | g (100) |
| comparative example 1 | 200 | coating material (1) | b (38) | j (38) |
| comparative example 2 | 1200 | coating material (1) | c (125) | g (100) |
| comparative example 3 | 600 | coating material (1) | d (50) | d (50) |
| comparative example 4 | 800 | coating material (1) | e (50) | g (100) |

FIG. 3

| | concentration of white pigment (weight %) | resin component | cushion ratio (%) | density | thickness (μm) |
|---|---|---|---|---|---|
| a | 5 | foam PET + PP | 18 | 1.0 | 50 |
| b | 5 | foam PET + PP | 22 | 0.8 | 50 |
| c | 5 | foam PET + PP | 18 | 1.0 | 125 |
| d | 5 | white PET | 3 | 1.4 | 50 |
| e | 0 | transparent PET | 3 | 1.4 | 50 |
| f | 5 | foam PET + PP | 22 | 0.8 | 100 |
| g | 5 | white PET | 3 | 1.4 | 100 |
| h | 7 | synthetic paper | 13 | 0.8 | 130 |
| i | 2 | RC paper | 10 | 1.0 | 140 |
| j | 5 | white PET | 3 | 1.4 | 38 |

IMAGE RECEIVING SHEET FOR THERMAL TRANSFER PRINTING

BACKGROUND OF THE INVENTION

The present invention relates to an image receiving sheet for thermal transfer printing suitable for use in a thermal transfer recording method and, particularly, a sublimation thermal transfer recording method. More particularly, the present invention relates to an image receiving sheet for thermal transfer printing comprising a seal portion and a support portion in which, after a thermal-transferred image is formed on the seal portion, the seal portion can be detached from the support portion and bonded to an object.

There is widely known a thermal transfer recording method in which, by selectively heating an ink ribbon with heating means, such as a thermal head, and a laser or the like, in response to an image information, a dye on the ink ribbon is transferred to an image receiving sheet by thermal diffusion, such as sublimation or the like, or a thermal fusion to thereby form an image on the image receiving sheet. Recently, a so-called sublimation thermal transfer recording method receives a remarkable attention. This method forms a full color image with continuous gradation by using a thermal-diffusive dye, such as a sublimable dye. An attempt is made on forming the image on the image receiving sheet in response to an image signal of a video image by using the sublimation thermal transfer recording method.

New usage of the image receives a remarkable attention. The new usage of the image is usage of the image formed by the sublimation thermal transfer recording method, i.e., bonding the transferred image to an arbitrary object, e.g., forming an image of a person on his business card, for example.

For realizing the image receiving sheet suitable for use in a seal label, an image receiving sheet for use in a seal label is proposed which comprises a seal portion on which an image is formed and a supporting mount portion supporting the seal portion and in which, after the image is formed on the seal portion, the seal portion can be detached from the support portion and bonded to an arbitrary object. The seal portion has a dye receiving layer having a base member made of white PET (poly(ethylene terephthalate)) or transparent PET as a base member, further having an adhesive layer on the side of the support portion.

However, having the seal portion comprising the base member made of white PET or transparent PET, the above image receiving sheet for use in the seal label is harder as compared with a general image receiving sheet for use in other areas than the seal label, hence being prevented from being conveyed in a printer satisfactorily. Moreover, the above image receiving sheet for use in the seal label has a large coefficient of thermal conductivity, thereby the image formed thereon becoming uneven and being lowered in sensitivity.

SUMMARY OF THE INVENTION

In view of the above-mentioned aspects, an object of the present invention is that an image receiving sheet for thermal transfer printing suitable for use in a seal label comprising a seal portion and a support portion can be stably conveyed in a printer and, moreover, an image having high sensitivity and high picture quality can be obtained thereon.

The assignee of the present invention found that the above objects could be achieved by using a foam film having a specific cushion property as a base member of the seal portion with setting stiffness of the image receiving sheet for thermal transfer printing within a specific range. Therefore, they accomplished the present invention.

Specifically, the image receiving sheet for thermal transfer printing according to the present invention comprises a dye receiving layer, the foam film, an adhesive layer, a release layer, a support layer and a lubricant layer which are successively laminated. The image receiving sheet for thermal transfer printing has the seal portion consisting of the dye receiving layer, the foam film and the adhesion layer, and also the support portion consisting of the release layer, the support layer and the lubricant layer. The image receiving sheet for thermal transfer printing according to the present invention is formed such that:

(1) smoothness of the dye receiving layer is equal to or larger than 2000 seconds;

(2) the foam film contains a white inorganic pigment of 5 to 30 weight % and a micro void formed by mixing resins that are not compatible with each other, having a cushion ratio of 5 to 30% and a density of 0.7 to 1.1 g/cm$^3$ measured in accordance with a measuring method of JIS L1015;

(3) each of the seal portion and the support has at least one antistatic layer; and (4) the stiffness of the whole image receiving sheet for the thermal transfer printing ranges from 400 to 1000 standard Gurley unit when it is measured in accordance with a measuring method of TAPPI (Technical Association of the Pulp and Paper Industry) T 543pm84.

The present invention will hereinafter be described in detail.

The image receiving sheet according to the present invention is basically formed such that the dye receiving layer, the foam film, the adhesive layer, the release layer, the support layer and the lubricant layer are successively laminated. The seal portion is composed of the dye receiving layer, the foam film and the adhesive layer, and the support portion is composed of the release layer, the support layer and the lubricant layer. As will be described in detail later, each of the seal portion and the support portion has at least one antistatic layer.

Similarly to a known image receiving sheet for use in a seal label, the seal portion and the support portion are kept integral while a transferred image is formed on the seal portion by thermal transfer recording. When the image is bonded to an arbitrary object after transferred to the seal portion, the seal portion is detached from the support portion and bonded to the object by adhesion of the adhesive layer of the seal portion.

The image receiving sheet according to the present invention is the image receiving sheet thus arranged and, for example, characterized in that the smoothness of the dye receiving layer is equal to or larger than 2000 seconds. If the smoothness is smaller than 2000 seconds, then a low density portion of the image is remarkably decreased in brightness to thereby lower its picture quality. Therefore, it is not preferable to set the smoothness of the dye receiving layer smaller than 2000 seconds.

The dye receiving layer can be made of various kinds of thermoplastic resin. Specifically, in view of sensitivity, preservation, writing and sebum resistance, the dye receiving layer is preferably made of resin having a main component made of cellulose resin or polyester resin or resin having a main component made of a polymer containing isocyanate group having polysiloxane part and urea-bonded part.

As disclosed in U.S. patent application Ser. No. 257093, the above polymer containing isocyanate group having polysiloxane part and urea bonded part is preferably made of a material obtained by allowing a compound of multifunctional polyisocyanate and silicone modified with amino to react with each other, or a material obtained by allowing a compound of multifunctional polyisocyanate and silicone modified by alcohol or silicone modified by carboxylic acid and amine compound or water to react with each other.

The dye receiving layer can contain various kinds of additives (sensitizers) which improve the dyeability of a dye because these additives are compatible with the resin composing the dye receiving layer and changes the resin into an amorphous state to allow the dye to be more diffused in the dye receiving layer and permeate the dye receiving layer deeply. The dye receiving layer can also contain various kinds of additives (sensitizers) which improve weathering resistance and heat resistance of the dye receiving layer. Such compounds used as the additives are compounds of ester class, compounds of ether class or hydrocarbon compounds which are liquid or solid with their melting points substantially ranging from −50° C. to 150° C. More specifically, the above compound of ester class is compound of phthalate class, such as dimethyl phthalate, diethyl phthalate, dioctyl phthalate, dicyclohexyl phthalate, diphenyl phthalate or the like, compound of aliphatic ester dibasic acid class, such as dioctyl adipate, dioctyl sebacate, dicyclohexyl azelate or the like, compound of ester phosphate class, such as triphenyl phosphate, tricyclohexyl phosphate, triethyl phosphate or the like, compound of ester isophthalate class, such as dimethyl isophthalate, diethyl isophthalate, dicyclohexyl isophthalate or the like, compound of higher fatty acid ester class, such as butyl stearate, cyclohexyl laurate or the like, compound of ester silicate class, or compound of ester borate and so on. The above compound of ether class is compound, such as diphenyl ether, dicyclohexyl ether, methyl ester p-ethoxybenzoate or the like. The hydrocarbon compound is camphor, polystyrene having low molecular weight, compound of phenol class, such as p-phenylphenol, o-phenylphenol or the like, or compound of amino N-ethyltoluene sulfonate class.

Moreover, the dye receiving layer can contain a fluorescent brightening agent and a white pigment which improve brightness of the dye receiving layer to thereby increase sharpness of the transferred image, allow the user to write smoothly on a surface of the layer and prevent the transferred image from being transferred again. The fluorescent brightening agent is one manufactured by Ciba Geigy Japan Ltd. under the trade name of UVITEX-OB, for example, and so on. The dye receiving layer can properly contain agents, such as a plasticizer, an ultraviolet absorber, an oxidation inhibitor and so on.

Thickness of the dye receiving layer is important because it, as well as cushion property, which will be described later, and thickness of the foam film, influences a coefficient of thermal conductivity of the image receiving sheet obtained when the image is formed on the sheet, and sensitivity thereof. Usually, the thickness is preferably set to 3 to 9 μm. If the thickness of the dye receiving layer is smaller than 3 μm, then the image formed thereon sometimes is decreased in brightness. If on the other hand it exceeds 9 μm, then the sensitivity of the image receiving sheet is hardly improved even by lowering the coefficient of thermal conductivity of the foam film.

According to the image receiving sheet of the present invention, the foam film thereof is a resin film containing the white inorganic pigment of 5 to 30 weight % and having the microvoid and has a specific cushion property having a cushion ratio ranging from 5 to 30%, more preferably from 8 to 25%, and a density of 0.7 to 1.1 g/cm$^3$ measured in accordance with a measuring method of JIS L1015.

When the foam film contains the white inorganic pigment of 5 to 30 weight %, the foam film can be brightened such that the brightness thereof exceeds 60, more preferably 70. Therefore, a target color of the image can be obtained and the image receiving sheet can obtain the preferable cushion property. On the other hand, if concentration of the white inorganic pigment is smaller than 5 weight %, then the seal portion of the image receiving sheet looks slightly yellow to thereby hardly obtain the target color of the image. Moreover, the image receiving sheet hardly obtain the desired cushion property to thereby lower the image quality. If concentration of the white inorganic pigment exceeds 30 weight %, then it is not preferable because the foam film tends to be broken with ease when formed.

The white inorganic pigment contained in the foam film is a compound, such as magnesium oxide, aluminum oxide, silicon oxide, titanium oxide, calcium carbonate, barium sulfate, magnesium carbonate, calcium silicate, talc or the like, or a mixture of these compounds.

The cushion ratio of the foam film is a value obtained by quantifying a change amount of the thickness of the foam film measured under a certain load, i.e., a value obtained as follows. Specifically, a dial gauge manufactured by Sanho Co., Ltd. (which is a type of No. 2109-10 and uses a hard ball of 3 mm ϕ as a measuring instrument) has a spindle to which a stand of 10 g is fitted at its upper portion. The spindle is lifted up and then brought down on a sample of the foam film on a measure plate. Subsequently, a weight of 50 g is put on the stand, and the thickness of the sample is measured after five seconds. A value of the thickness at this time is referred to as a (μm). Thereafter, the weight on the stand is replaced by another weight of 500 g, and the thickness of the sample is measured after five seconds. A value of the thickness at this time is referred to as b (μm). Then, the cushion ratio of the foam film is calculated by the following equation:

$$C=100\times(a-b)/a$$

When the cushion ratio of the foam film thus calculated is preferably set to 5 to 30%, more preferably 8 to 25% and the density thereof (measured in accordance with the measuring method of JIS L1015) is set to 0.7 to 1.1 g/cm$^3$, the image receiving sheet can satisfactorily be brought in contact with a head portion of a printer and the image quality of the obtained image can be improved. Moreover, the coefficient of the thermal conductivity of the image receiving sheet is lowered to prevent heat, which is caused when the image is formed on the sheet, from being diffused unnecessarily, so that the sensitivity of the image receiving sheet can be improved. When the cushion ratio of the foam film is smaller than 5%, the foam film becomes hard. Therefore, the sheet cannot satisfactorily be brought in contact with the head of the printer to lower the image quality of the obtained image. On the other hand, when the cushion ratio of the foam film exceeds 30%, it is not preferable because the foam film tends to be broken with ease when formed. When the density of the foam film is smaller than 0.7 g/cm$^3$, it is not preferable because heat resistance of the foam film is sometimes lowered to melt the foam film and the image quality of the image is lowered. On the other hand, if the density of the foam film exceeds 1.1 g/cm$^3$, then it is not preferable because the coefficient of thermal conductivity thereof becomes too large to lower the sensitivity.

The foam film having such cushion property (i.e., the cushion ratio and the density) can be obtained by combining and stretching resins, which are not compatible with each other, to form the microvoids in a film made of the resins, e.g., by biaxially stretching polyester copolymer and resin which is not compatible therewith.

It is preferable that the polyester copolymer has ethylene terephthalate as a main repeating unit. Such polyester copolymer may contain various kinds of additives publicly known, such as the oxide inhibitor, the antistatic agent, the brightening agent, the ultraviolet absorber or the like.

The resin which is not compatible with the polyester copolymer is resin, such as polyethylene, polypropylene, polyacrylonitrile, poly(vinyl chloride), vinyl chloride-vinyl acetate copolymer, polystyrene-acryl copolymer or the like.

The thickness of the above foam film is preferably set to 15 to 100 μm. If the film is too thin, then it is not preferable because the image receiving sheet is hardly stretched. On the other hand, if the film is too thick, then it is not preferable because the film is not soft and the image receiving sheet becomes too hard.

According to the image receiving sheet of the present invention, the adhesive layer, the release layer, the support layer and the lubricant layer can be formed similarly to the image receiving sheet for the seal label which is available on market. For example, the support layer can be made of a resin film, such as polyester film or the like, various kinds of a paper made of natural material and synthetic papers, and a foam PET (poly(ethylene terephthalate)) similar to the above-mentioned foam film and so on. Particularly, in view of the image quality and transfer density of the transferred image and conveyance property of the image receiving sheet in the printer, it is preferable that the support layer is a synthetic paper of multilayer structure with void which is formed by biaxially stretching a resin material made of polyolefin (e.g., polypropylene) and an inorganic pigment as their main components, or a base paper containing cellulose pulp as its main component which is provided with a resin-coated layer.

According to the image receiving sheet of the present invention, it is one of the features that each of the seal portion and the support portion has more than one antistatic layer. Since the dye receiving layer has smoothness of 200 seconds or more as described above, the image receiving sheet according to the present invention is very smooth. Therefore, it is frequently observed that two sheets or more are simultaneously conveyed by static electricity when the image receiving sheet is conveyed in the printer. However, since more than one antistatic layer is provided in the seal portion, such defect that two sheets or more are conveyed simultaneously in the printer can be removed. Further, more than one antistatic layer is provided in the support layer, so that two sheets or more are prevented from being conveyed simultaneously in the printer.

The antistatic layer of the seal portion can be formed on a surface of the dye receiving layer or between the dye receiving layer and the foam film. Alternatively, the dye receiving layer may contain the antistatic agent such that the dye receiving layer itself can also serve as the antistatic layer.

The antistatic layer of the support layer can be formed between the support layer and the lubricant layer. The lubricant layer may contain the antistatic agent such that the lubricant layer itself can also serve as the antistatic layer.

The antistatic agent used to form the above antistatic layer includes various kinds of surface active agents, such as a cationic surface active agent (such as quaternary ammonium salt, polyamine derivative or the like), an anionic surface active agent (alkylbenzenesulfonate, sodium compound of alkylsulfate ester and so on), an amphoteric surface active agent, a nonionic surface active agent and so on.

The image receiving sheet according to the present invention includes the respective layers described above and should have its entire stiffness ranging from 400 to 1000 standard Gurley measured according to TAPPI T 543pm84. If the stiffness is smaller than the above range, then it is not preferable that the image receiving sheet is not satisfactorily conveyed in the printer since it is difficult to stretch. If on the other hand the stiffness exceeds the above range, then it is not preferably that the image receiving sheet is not satisfactorily conveyed in the printer since it is not satisfactorily wound around a platen roll of the printer. Moreover, it is not preferable since the image quality of the transferred image is lowered, e.g., the transferred image is decreased in brightness.

The known thermal transfer recording method can be applied to a method of forming the image on the image receiving sheet according to the present invention. Specifically, the sublimation thermal transfer recording method can preferably be applied thereto.

BRIEF DESCRIPTION OF THE DRAWINGS

FIG. 2 is a table showing samples of inventive examples 1 through 6 and comparative examples 1 through 4; and FIG. 3 is a table showing foam films and support layers used in inventive examples 1 through 6 and comparative examples 1 through 4.

DESCRIPTION OF THE PREFERRED EMBODIMENTS

Figure 1:
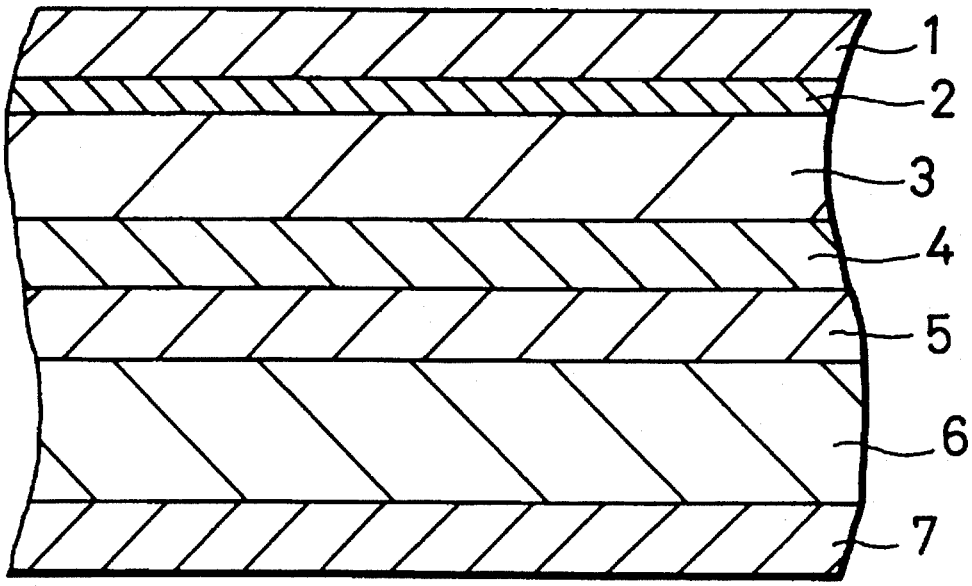
FIG. 1 is a cross-sectional view showing an image receiving sheet according to an embodiment of the present invention.

A concrete embodiment of the present invention will hereinafter be described.

INVENTIVE EXAMPLE 1

As shown in FIG. 1, an image receiving sheet having a dye receiving layer 1, an antistatic layer 2, a foam film 3, an adhesive layer 4, a release layer 5, a support layer 6 and an antistatic and lubricant layer 7, which were successively laminated, was manufactured as follows.

A coating material (1) used to form the dye receiving layer 1 was prepared as follows.

Preparation of the Coating Material (1)

Polyester resin (manufactured by TOYOBO CO., LTD. under the trade name of VYLON 200) of 100 parts by weight, silicone modified by amino (manufactured by Shin-Etsu Chemical Co., Ltd. under the trade name of X-22-161B) of 5 parts by weight, and multifunctional polyisocyanate (manufactured by Takeda Chemical Industries, Ltd. under the trade name of Takenate D110N) of 5 parts by weight were simultaneously dissolved in a solution made by mixing toluene and methyl ethyl ketone (in the ratio of 5 to 1). A 20% solution thereof was prepared as the coating agent (1).

The foam film 3 was formed of a foam film (manufactured by Toray Industries, Inc. under the trade name of 50E63) which contained polyester and polypropylene as main resin components and included microvoids formed therein with its concentration of white inorganic pigment of 5 weight %, its density of 1.0 g/cm$^3$ measured in accordance with a measuring method of JIS L1015, its cushion ratio of 18%, and its thickness of 50 μm. The foam film 3 was coated on its one surface with an antistatic agent (manufactured by MITSUBISHI PETROCHEMICAL CO., LTD. under the trade name of ST-2000) with its thickness of 0.3 μm for thereby forming the antistatic layer 2. The above coating agent (1) was coated on the antistatic layer 2 by dye coating in proportion of solid components of 5 g/m$^2$ and dried to thereby form the dye receiving layer 1. Thereafter, an acrylic adhesive (manufactured by TOYO INK MFG. CO., LTD. under the trade name of Oribain BPS) was coated on the other surface of the foam film 3 in proportion of 10 g/m$^2$, thereby forming the adhesive layer 4.

The support layer 6 was formed of a resin film (manufactured by TEIJIN LTD. under the trade name of W900E) which contained polyester as its main component with its thickness of 100 μm. The support layer 6 was coated on its one surface with the antistatic agent (manufactured by MITSUBISHI PETROCHEMICAL CO., LTD. under the trade name of ST-2000) for thereby forming the antistatic and lubricant layer 7. The support layer 6 was coated on the other surface thereof with a silicone resin (manufactured by Dow Corning Toray Silicone CO., Ltd. under the trade name of SRX290) for thereby forming the release layer 5. The image receiving sheet was formed by bonding the release layer 5 of the support portion and the adhesive layer 4 of the seal portion to each other.

Measurement was made on stiffness ρ of the obtained image receiving sheet in accordance with the measuring method of TAPPI T 543pm84. The stiffness ρ was 600 standard Gurley unit.

INVENTIVE EXAMPLES 2 THROUGH 6 AND COMPARATIVE EXAMPLES 1 THROUGH 4.

As shown in FIG. 2, the image receiving sheet was manufactured similarly to that of inventive example 1 except that the dye receiving layer 1 was made of the above coating material (1) or a coating material (2) or (3) prepared as follows and the foam film 3 and the support film 6 were one of films a through e and one of films f through j shown in FIG. 3. Measurements were made on stiffness ρ by Gurley of the obtained image receiving sheets similarly to inventive example 1.

Preparation of the Coating Material (2)

Cellulose acetate butyrate resin (manufactured by EASTMAN KODAK CO., LTD. under the trade name of CAB-273-3) of 100 parts by weight, silicone modified by amino (manufactured by Shin-Etsu Chemical Co., Ltd. under the trade name of X-22-161B) of 5 parts by weight, and multifunctional polyisocyanate (manufactured by Takeda Chemical Industries, Ltd. under the trade name of Takenate D110N) of 5 parts by weight were simultaneously dissolved in a solution made by mixing toluene and methyl ethyl ketone (in the ratio of 5 to 1). A 20% solution thereof was prepared as the coating agent (2).

Preparation of the Coating Material (3)

Silicone modified by alcohol (manufactured by Shin-Etsu Chemical Co., Ltd. under the trade name of X-22-4015) of 5 parts by weight, multifunctional polyisocyanate (manufactured by Takeda Chemical Industries, Ltd. under the trade name of Takenate D110N) of 5 parts by weight and hexamethylenediamine of 3 parts by weight were simultaneously dissolved in a solution made by mixing toluene and methyl ethyl ketone (in the ratio of 5 to 1) to prepare a 20% solution thereof. The solution was stirred at 80° C. for 24 hours for reaction to obtain a solution of polymer containing isocyanate group. Cellulose acetate butyrate resin (manufactured by EASTMAN KODAK CO., LTD. under the trade name of CAB-273-3) was dissolved in a solution made by mixing toluene and methyl ethyl ketone (in the ratio of 5 to 1) to prepare a 20-weight-% solution thereof. The former solution of 30 parts by weight and the latter solution of 100 parts by weight were mixed to prepare the coating agent (3).

EVALUATION

Solid printing was carried out by a sublimation color video printer (manufactured by SONY CORP. under the trade name of G7), which was available on market, on the image receiving sheets (whose trimmed sizes were A6 according to JIS P 0138, i.e., 105 mm×148 mm) of inventive examples 1 through 6 and comparative examples 1 through 4. Evaluation was made on how the image receiving sheets were conveyed while they were printed, how the image receiving sheets were curled after they were printed, how print densities thereof were, whether or not the images on the image receiving sheets were decreased in brightness, and how uneven the image qualities of the images thereon were. In the evaluation, when the image receiving sheets were put on a plane after they were printed, if a positional height of each corner of the image receiving sheet was 10 mm, then it was evaluated that the image receiving sheet was curled satisfactorily. The print density of image received surfaces of the image receiving sheets was measured by the Macbeth type densitometer RD-914. It was evaluated by visual measurement of the images thereon how the images on the image receiving sheets were decreased in brightness and how uneven the images thereon were. The measured results are shown in Tables 1 and 2.

TABLE 1

| | conveyance property of the sheet | curl of corners of the sheet |
|---|---|---|
| inventive example 1 | satisfactory | satisfactory |
| inventive example 2 | satisfactory | satisfactory |
| inventive example 3 | satisfactory | satisfactory |
| inventive example 4 | satisfactory | satisfactory |
| inventive example 5 | satisfactory | satisfactory |
| inventive example 6 | satisfactory | satisfactory |
| comparative example 1 | impossible | — |
| comparative example 2 | impossible | — |
| comparative example 3 | satisfactory | satisfactory |
| comparative example 4 | satisfactory | satisfactory |

TABLE 2

| | print density | decrease of brightness | unevenness in image quality |
|---|---|---|---|
| inventive example 1 | 2.53 | none | none |
| inventive example 2 | 2.38 | none | none |
| inventive example 3 | 2.42 | none | none |
| inventive example 4 | 2.43 | none | none |
| inventive example 5 | 2.26 | none | none |
| inventive example 6 | 2.21 | none | none |
| comparative example 1 | — | — | — |
| comparative example 2 | — | — | — |
| comparative example 3 | 2.08 | decreased | uneven when print density is low |
| comparative example 4 | 2.02 | decreased | uneven when print density is low |

As shown in Tables 1 and 2, the image receiving sheet of comparative example 1 was not conveyed into the printer since its stiffness ρ by Gurley was smaller than the range thereof according to the present invention. The image receiving sheet of comparative example 2 was not wound around the platen roll in the printer since its stiffness ρ by Gurley was larger than the range thereof according to the present invention. Therefore, both of the image receiving sheets could not be printed since each of them is very poor in conveyance property. Although having the satisfactory stiffness ρ by Gurley within the range according to the present invention, the image receiving sheets of comparative examples 3 and 4 have lower cushion ratios as compared with the range thereof according to the present invention and larger densities as compared with the range thereof according to the present invention, so that they had the images of unsatisfactory image qualities since print densities of the images were low and their transferred images were decreased in brightness and uneven in image quality. On the other hand, all the image receiving sheets of the inventive examples were satisfactorily conveyed and had the images of satisfactory image qualities.

The image receiving sheet according to the present invention is the image receiving sheet for thermal transfer printing suitable for use in the seal label comprising the seal portion and the support portion. The image receiving sheet according to the present invention can stably be conveyed in the printer and can be printed with high-sensitivity and high image quality image.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. An image receiving sheet for thermal transfer printing, comprising:

a dye receiving layer;

a foam film;

an adhesive layer;

a release layer;

a support layer; and a lubricant layer, which are successively laminated, said dye receiving layer, said foam film and said adhesion layer composing a seal portion, said release layer, said support layer and said lubricant layer composing a support portion, wherein smoothness of said dye receiving layer is equal to or larger than 2000 seconds, wherein said foam film contains a white inorganic pigment of 5 to 30 weight % and has a microvoid formed by mixing resins that are not compatible with each other, having a cushion ratio of 5 to 30% and a density of 0.7 to 1.1 g/cm$^3$ measured in accordance with a measuring method of JIS L1015, wherein each of said seal portion and said support portion has more than one antistatic layer; and wherein stiffness of the whole image receiving sheet for the thermal transfer printing ranges from 400 to 1000 standard Gurley unit when it is measured in accordance with a measuring method of TAPPI T 543pm84.

2. The image receiving sheet for thermal transfer printing according to claim 1, wherein said dye receiving layer contains cellulose resin or polyester resin as its main component.

3. The image receiving sheet for thermal transfer printing according to claim 1, wherein said dye receiving layer contains a polymer containing isocyanate group having polysiloxane unit and urea-bonded unit.

4. The image receiving sheet for thermal transfer printing according to claim 1, wherein said support layer is a synthetic paper of polypropylene.

5. The image receiving sheet for thermal transfer printing according to claim 1, wherein said support layer has a base paper containing a cellulose pulp as its main component and a resin-coated layer formed on said base paper.

* * * * *